US006709307B2

(12) United States Patent
Garofalo et al.

(10) Patent No.: US 6,709,307 B2
(45) Date of Patent: Mar. 23, 2004

(54) INFLATING DEVICE FOR BALANCING JACKETS FOR DIVING ACTIVITIES EQUIPPED WITH HORSESHOE-SHAPED INFLATABLE CHAMBER

(75) Inventors: Giovanni Garofalo, Rapallo (IT); Gabriele Canella, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 10/346,115

(22) Filed: Jan. 17, 2003

(65) Prior Publication Data

US 2004/0005827 A1 Jan. 8, 2004

(30) Foreign Application Priority Data

Jul. 5, 2002 (IT) ..... GE2002 U 000011

(51) Int. Cl.[7] ..... B63C 9/105
(52) U.S. Cl. ..... 441/96; 405/186
(58) Field of Search ..... 405/185, 186; 441/88, 90–101, 106, 111–119; 114/345

(56) References Cited

U.S. PATENT DOCUMENTS 3,337,887 A * 8/1967 Barnier ..... 405/186
3,608,114 A * 9/1971 Middleton et al. ..... 441/94
6,168,487 B1 * 1/2001 Nissen ..... 441/92

* cited by examiner

*Primary Examiner*—Ed Swinehart
(74) *Attorney, Agent, or Firm*—Stites & Harbison PLLC; Marvin Petry

(57) ABSTRACT

Inflating device for balancing jackets for diving activities equipped with at least partially horseshoe-shaped inflatable chamber comprising two descending branches communicating one with the other on their upper portion, characterized in that on the connection of the inflating valve ending on the base of one of the branches of the inflatable chamber of the jacket is arranged a tubular connection with a substantially T-shaped branch comprising a first tube portion ending directly on the basis of said first chamber, and a second tube portion covering the whole ascending arch of said first chamber and at least part of the descending arch of the second chamber of the jacket until it ends on the base of the second inflatable chamber of said jacket.

1 Claim, 1 Drawing Sheet

INFLATING DEVICE FOR BALANCING JACKETS FOR DIVING ACTIVITIES EQUIPPED WITH HORSESHOE-SHAPED INFLATABLE CHAMBER

BACKGROUND AND SUMMARY OF THE INVENTION

The present invention relates to balancing jackets for diving activities, and in particular to balancing jackets equipped with a substantially horseshoe-shaped inflatable chamber, or anyway equipped with an inflatable chamber comprising two descending branches communicating one with the other in their upper portion.

One of the most relevant problems involving these known jackets consists in obtaining a balanced bilateral inflation of both branches of the air chamber. Such balanced inflation can be reached only by arranging the inflating valve in central position between the two branches, which would mean arranging such valve at the same height as the user's nape, and further providing transmission means, such as for instance a cable transmission, for enabling its actuation. However, if in order to obviate to the above mentioned drawback of the central positioning, said valve is placed on one of the sides of a chamber (which can either be the left or right chamber, whether the user is right-handed or left-handed), substantially at the same height as the user's hips, this arrangement results in a lot of drawbacks due to the fact that air supplied into the jacket fills one of the two branches of said jacket before passing on to the second branch, which results in the diver being unbalanced. This drawback often results in divers choosing other types of jackets despite the indubitable advantages of this kind of jacket.

The main aim of the present invention is therefore to obviate the drawbacks of known balancing jackets equipped with horseshoe-shaped inflatable chamber, i.e. comprising two descending branches communicating one with the other in their upper portion.

According to a main feature of the present invention said aim is reached by arranging on the connection of the inflating valve ending within one of the two branches of the inflatable chamber of the jacket a tubular connection provided with a substantially T-shaped branch comprising a first tube portion ending directly on the base of such first chamber, and a second tube portion covering the whole ascending arch of said first chamber and at least a large portion of the descending arch of the second chamber of the jacket until it ends on the base of the second inflatable chamber of said jacket. Thus, as soon as air is supplied into the jacket it is uniformly divided between the two chambers or branches of said jacket.

BRIEF DESCRIPTION OF THE DRAWINGS

Further aims and advantages of the present invention will be evident from the following detailed description of a preferred embodiment of said invention carried out with reference to the only figure of the enclosed drawing, which shows a view of a jacket according to the invention where the hatch-and-dot line represents the system for supplying air between the two branches of the horseshoe-shaped chamber of said jacket.

DESCRIPTION OF THE PREFERRED EMBODIMENT OF THE INVENTION

Figure 1:
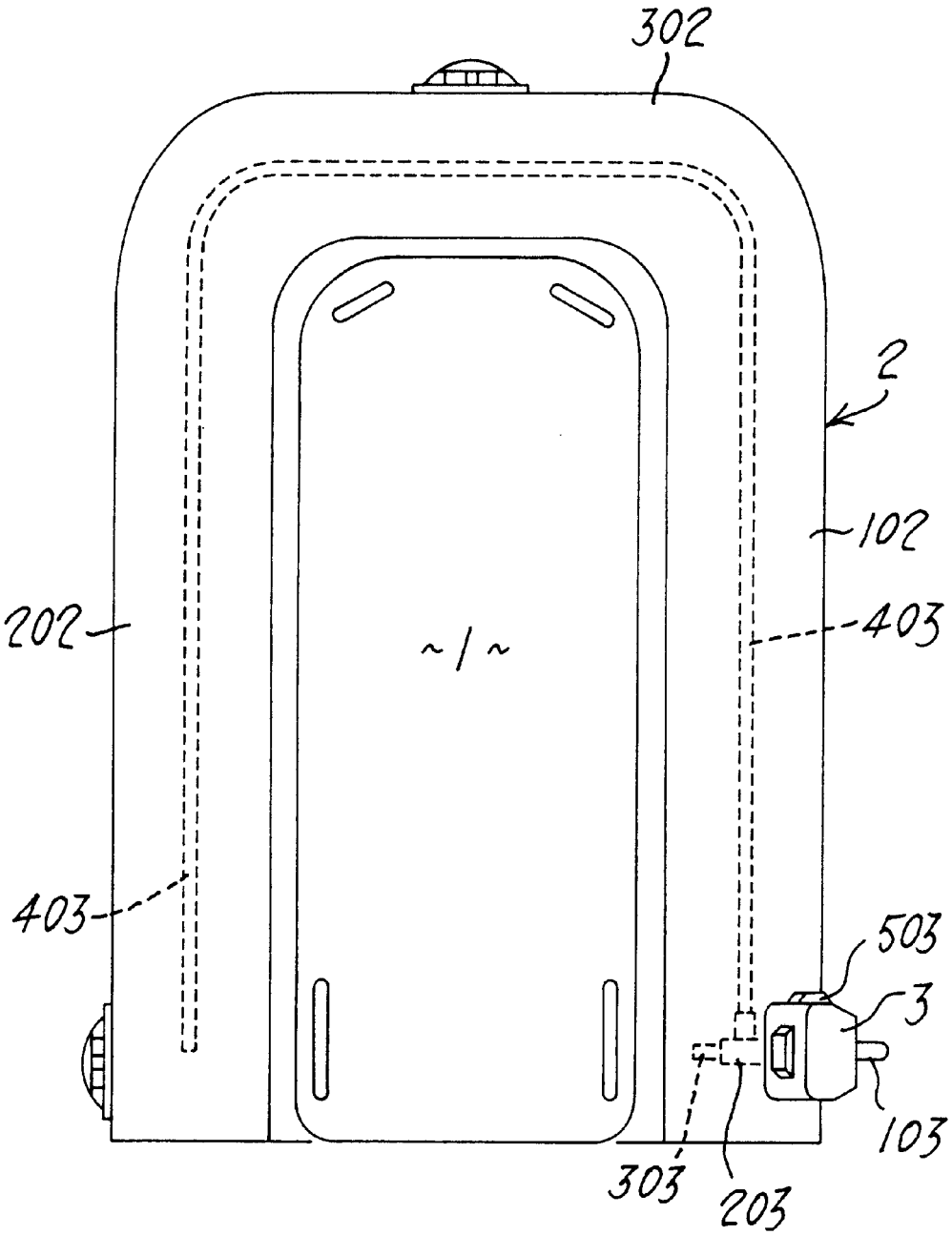

With reference to the drawing, the numeral 1 refers to a back to which the jacket 2 is connected. As shown, said jacket is of the horseshoe type, i.e. it comprises an air chamber equipped with two symmetrical lateral descending branches 102 and 202 joined one to the other on the top by means of a portion 302. The numeral 3 refers to the inflating valve, whose intake 103 is supplied by means of a suitable hose (not shown) from the diver's bottle of compressed air (again not shown). Said valve is placed in the base area of one of the branches of the air chamber of the jacket, and in the case shown branch 102, and its outlet duct 203 for compressed air communicates with the inside of said branch 102. Said outlet duct 203 is carried out as a T connection and comprises a first tubular portion 303 communicating directly with the base of the branch 102 of the inflatable chamber of the jacket, and a second tubular portion 403 extending on the whole ascending portion of the chamber 102, beyond the upper portion 302 and descending on the whole portion of the chamber 202 until it ends on the base of said chamber 202.

The working of the described device will be evident. When the pushbutton 503 of the valve 3 is pressed to supply air into the inflatable chamber of the jacket 2, air is supplied simultaneously into the base of both chambers 102 and 202 of said jacket in a wholly balanced way.

Obviously, the present invention is not limited to the embodiment shown and described, but it includes all those changes and variations that fall within the ampler framework of the inventive idea, substantially as claimed later.

We claim:

1. Inflating device for balancing jackets for diving activities equipped with at least partially horseshoe-shaped inflatable chamber comprising a first and a second descending branch communicating one with the other on their upper portion, said first branch being provided at one end with an inflating valve, and in which on the connection of the said inflating valve a tubular connection is arranged provided with a substantially T-shaped branch comprising a first tube portion ending directly on the basis of said first branch of said chamber, and a second tube portion extending through the whole ascending arch of said first branch of said chamber and at least part of the descending arch of the second branch of said chamber of the jacket until it opens at the base of the said second inflatable branch of the said chamber of the jacket.

* * * * *